US011834893B1

(12) United States Patent
Pigott, Jr.

(10) Patent No.: US 11,834,893 B1
(45) Date of Patent: Dec. 5, 2023

(54) REPLACEMENT WINDOW CLADDING METHOD AND SYSTEM

(71) Applicant: Pigott Agency, LLC, Mechanicsburg, PA (US)

(72) Inventor: James Patrick Pigott, Jr., Mechanicsburg, PA (US)

(73) Assignee: PIGOTT AGENCY, LLC, Mechanicsburg, PA (US)

( * ) Notice: Subject to any disclaimer, the term of this patent is extended or adjusted under 35 U.S.C. 154(b) by 255 days.

(21) Appl. No.: 16/788,287

(22) Filed: Feb. 11, 2020

Related U.S. Application Data

(63) Continuation-in-part of application No. 15/590,894, filed on May 9, 2017, now Pat. No. 10,557,302, which is a continuation-in-part of application No. 14/461,333, filed on Aug. 15, 2014, now Pat. No. 9,644,380.

(Continued)

(51) Int. Cl.

| | |
|---|---|
| ***E04G 23/02*** | (2006.01) |
| ***E06B 3/30*** | (2006.01) |
| ***E06B 1/02*** | (2006.01) |
| ***E06B 1/34*** | (2006.01) |
| ***E06B 1/36*** | (2006.01) |
| ***E06B 1/70*** | (2006.01) |
| ***E06B 3/44*** | (2006.01) |
| ***E06B 3/96*** | (2006.01) |
| ***E06B 1/60*** | (2006.01) |
| *E06B 1/62* | (2006.01) |

(52) U.S. Cl.
CPC ..... *E06B 3/30* (2013.01); *E04G 23/0277* (2013.01); *E06B 1/02* (2013.01); *E06B 1/345* (2013.01); *E06B 1/36* (2013.01); *E06B 1/6015* (2013.01); *E06B 1/702* (2013.01); *E06B 3/4415* (2013.01); *E06B 3/96* (2013.01); *E06B 2001/628* (2013.01); *E06B 2003/4461* (2013.01)

(58) Field of Classification Search
CPC . E06B 1/345; E06B 1/347; E06B 1/00; E06B 1/02; E06B 1/04; E06B 1/26; E06B 1/28; E06B 1/30; E06B 1/56; E06B 3/04; E06B 3/26; E06B 2003/262; E06B 2003/7059
See application file for complete search history.

(56) References Cited

U.S. PATENT DOCUMENTS 6,530,190 B2 * 3/2003 Conachen ..... E06B 3/44 49/492.1
7,296,381 B1 * 11/2007 McCabe ..... E06B 3/5063 49/176

(Continued)

*Primary Examiner* — Jessica L Laux
(74) *Attorney, Agent, or Firm* — Wilkinson Law Office; Clinton H. Wilkinson

(57) ABSTRACT

A window unit and replacement window cladding method and system which is provided as a single unit to be installed as a complete new window that fits over the head jamb, side jamb and sill of an existing window frame and the old window frame that is cladded with head jamb, side jamb, and sill cover assemblies defining an opening in which one or more sash units is pivotally secured forming a replacement window unit, without any loss of glass size and egress, and without disturbing the building interior, and further including a clip arrangement for securing the head and side jamb assembly to the front surface of the old window frame.

20 Claims, 6 Drawing Sheets

Related U.S. Application Data

(60) Provisional application No. 61/866,218, filed on Aug. 15, 2013.

(56) References Cited

U.S. PATENT DOCUMENTS

| | | | | |
|---|---|---|---|---|
| 7,631,465 | B2 * | 12/2009 | Curtis | E06B 3/44 52/204.5 |
| 2009/0293387 | A1 * | 12/2009 | Miethe | E06B 1/02 52/204.62 |

* cited by examiner

REPLACEMENT WINDOW CLADDING METHOD AND SYSTEM

CROSS-REFERENCE TO PREVIOUS RELATED APPLICATION

This application is a continuation-in-part of U.S. Pat. No. 10,557,302 issued on Feb. 11, 2020, which is a continuation-in-part of U.S. Pat. No. 9,644,380 issued on May 9, 2017, which claims priority to U.S. Provisional Pat. Appln. Ser. No. 61/866,281, filed on Aug. 15, 2013, the entirety of the disclosures of which applications and patents is hereby incorporated by reference.

FIELD OF THE INVENTION

The present invention relates to window constructions and cladding systems for windows, and more particularly to a method and system for installing replacement windows and cladding existing window frames.

BACKGROUND OF THE INVENTION

It is often desired to update or remodel dwellings and structures by replacing the original or existing windows with new, more energy efficient windows. Current methods of replacement window installation may require removal of the entire old window unit including the original frame, or may utilize the original window frame and insert another window unit having its own frame inside the original frame or sash pocket. In one current method, a bent coil stock is applied over the old exterior wood, a bead of sealant is applied around the inside perimeter of the old blind stop, and the new window and frame is then set in the old frame.

A drawback of window replacement using a window unit having its own frame is that it creates a double frame, which takes up a substantial amount of space in the old frame and reduces the amount of vision glass by as much as five inches. In addition, the egress size, or window size required by law for egress in a fire or the like in areas such as basements and sleeping rooms in residential buildings, may be reduced below minimum size requirements. For example, sleeping rooms are required by current International Residential Code (IRC) to have an openable area of not less than 5.7 square feet, an opening height of not less than twenty-four inches, and an opening width of not less than twenty inches. Another drawback of current methods is that they do not allow for installation of insulation between the window frame and the stud opening gap or pocket. Insulating the stud opening pocket is important and improves the energy savings and reduces air leaking between the house or building wall and the window frame. A further drawback of current methods is that the overall appearance of the original window is changed, primarily due to the change in ratio of frame to glass in the window unit.

It therefore would be desirable to provide a system and method for installing replacement windows that overcomes the disadvantages of existing systems and methods, and in addition includes a new clad frame having built in sash and counter balances which are precisely measured to fit over the old wood frame, such that the old window frame becomes a clad window and does not increase the frame size and decrease vision size.

BRIEF SUMMARY OF THE INVENTION

An exterior window unit and associated method and system in which the window unit is provided as a single unit to be installed as a complete new window over a window opening or old window frame. Where the window unit is installed as a new exterior replacement window system, components such as the old window sashes, moldings, brickmold casing, head and side blind stops, and parting stops are removed from around the old window frame so that the new window unit can be secured directly to the old window frame old side jambs, head jamb, and sill. As part of the window system and method, a cladding is secured over the old window frame, including an elongated clad jamb assembly which is secured to both the existing window opening side jambs and head jamb, and a separate sill assembly cladding. The clad jamb assembly includes a head adapter for attachment to and use with the head jamb cladding, and a frame adapter for attachment to and use with the side jamb cladding. The side and head jamb assemblies include a nailing fin to facilitate attachment of the assemblies over the original or existing window frame, while in other embodiments a clip system is utilized to secure the jamb assembly directly to the outwardly facing surface of the old window frame head and side jambs. The sill assembly includes an adapter piece that allows the sill cladding to be adjusted for changes in contour of the original sill. The side and head jamb assemblies also are adapted for each attachment of other window unit components in place of the discarded brickmould and trim. The old window is converted into a modern clad window in which the cladding may be of any suitable material such as aluminum, vinyl, fiberglass, and other metal claddings, and the entire window framing material may be vinyl, PVC, metal, fiberglass, or wood.

This present window replacement method and system solves problems that have existed in replacement windows since the 1960's. Utilizing the already secured portion of the frame where connected to the interior of the structure, without disrupting or disturbing interior lead paint, further maintains the integrity of the home or structure and matches new construction window technology, warmth and beauty without loss of egress or loss of vision of view glass. The window replacement unit can be certified to "Energy Star" standards. Installation requires complete inspection of the condition of the home or structure. Customers that have exterior insulating finish systems or stucco who are looking for a solution to expensive window replacement can use this system as it deals with the exterior to be installed and gives the owner and the installer the perfect circumstance to inspect and fix the problems. The present invention provides a window system which results in proper and better window replacement, resulting in no leaks, no loss of glass in size, and no loss of egress for fire department and building owners, as well as no disturbance of interior lead paint since the interior of the existing frame is not disturbed. In addition, standard new construction window accessories fit into the accessory kerf to allow wider trims and larger sills made from low maintenance materials.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
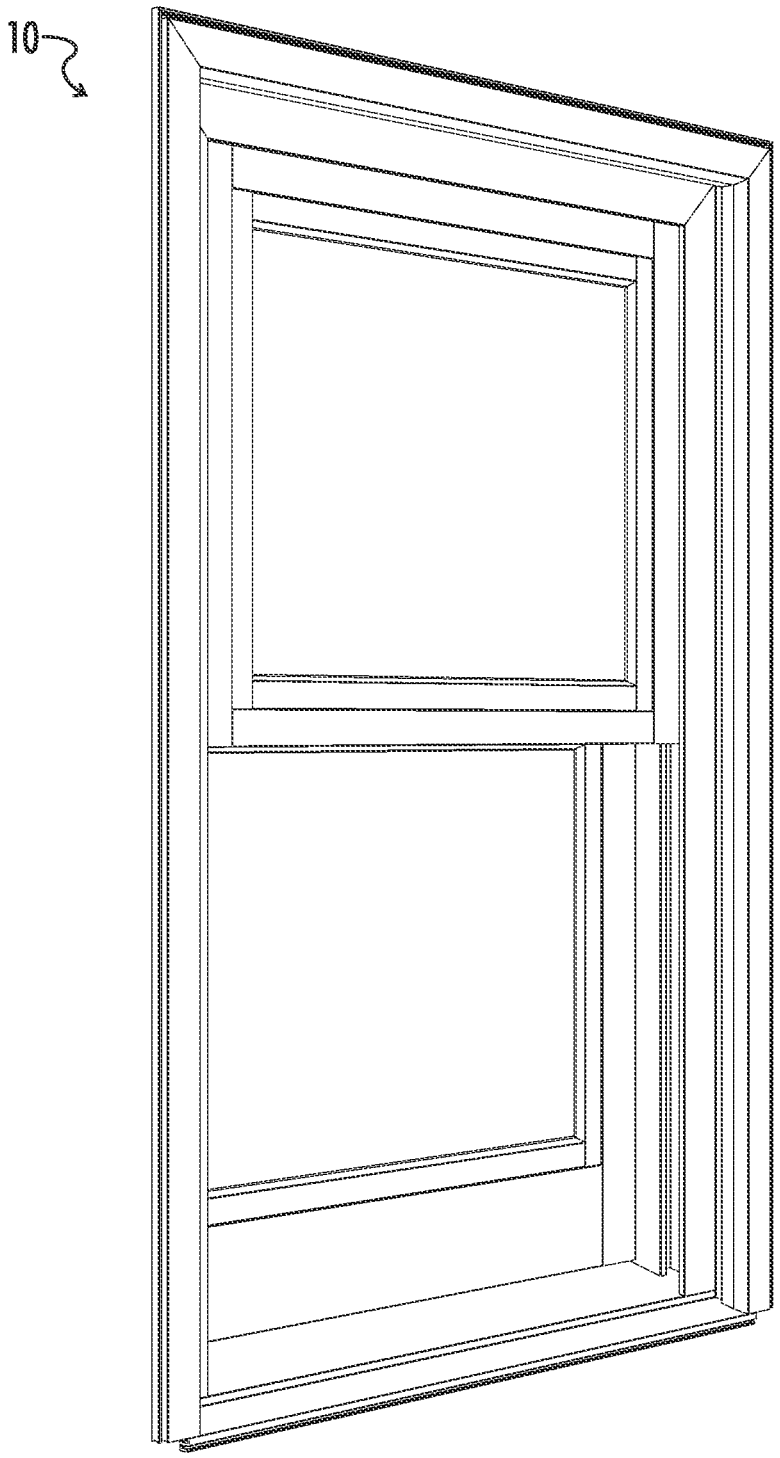
FIG. 1 is a perspective view of an embodiment of a replacement window unit according to the system and method of the present invention.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. The components in the drawings are not necessarily drawn to scale, the emphasis instead being placed upon clearly illustrating the principles and manner of use of the invention. Moreover, in the drawings, like reference numerals designate corresponding parts throughout the several views. Wherever possible, the same reference numbers are used throughout the drawings to refer to the same or like elements of an embodiment.

FIG. 1 illustrates an embodiment of a new exterior replacement window unit 10 manufactured in accordance with the method and system of the present invention, which is provided as a single unit to be installed as a complete new window that fits over the head, side jamb and sill of the old window to be replaced. In preparing the old window opening for installation of the new exterior replacement window system of the invention, the old window sashes, moldings, brickmold casing, head and side blind stops, and parting stops are removed from around the old window frame. This leaves the old window frame, including the old side jambs, head jamb, and sill which are to be reused if possible. It will be understood, however, that prior to installation of the new exterior replacement window unit 10, first the old frame is checked for wood rot, water damage, dry rot and other damage, and all necessary repairs are made.

Unlike other replacement window installations where either the old frame is completely removed or the new window including a new frame is installed in the old frame, in the present system the old window is replaced by a new complete window that fits over the old frame, and includes a new clad frame with built-in sashes and counter balances which have been precisely measured to fit over the old wood frame, such that the old window frame is converted into a clad window. In a limited number of circumstances, particularly in the case of historic windows or for personal reasons, the old sashes could be retrofitted for use with the present old frame cladding method and system, although in general this is likely to be more costly and labor intensive than installing a complete new replacement window unit 10. The new sashes of the replacement window unit 10 may need to be removed from the window unit 10 temporarily after the unit is inserted in the old frame, in order for the new window and cladding system to be properly anchored to the old frame as described in detail below, after which the new sashes are put back in place. In one embodiment, the new windows are deep, having a width of about 4⅛" and abut against the old inside trim that was nailed on when the old windows were originally installed.

The replacement window installation method and system of the present invention has numerous advantages over existing systems, and eliminates problems and complaints associated with current style replacement windows, including loss of glass area. For example, a current window replacement system resulted in a reduction of the glass width from 26" to 23½" and in the overall glass height from 52" to 46" (per sash height of glass lost from 25" to 22½", or about 10%). In contrast, loss of glass area in the present inventor's replacement window system ranges from 0% to possibly 1%. In addition, a double frame system gives the window a thicker frame look, since the ratio of glass to frame has a dramatic primarily negative change in appearance. In contrast, the present system maintains more of the original architectural look and feel of the building structure, as the same look to the interior and exterior is provided. The new system also gives the appearance of a new construction window and can closely match any new construction that may be added to a construction project.

Figure 2:
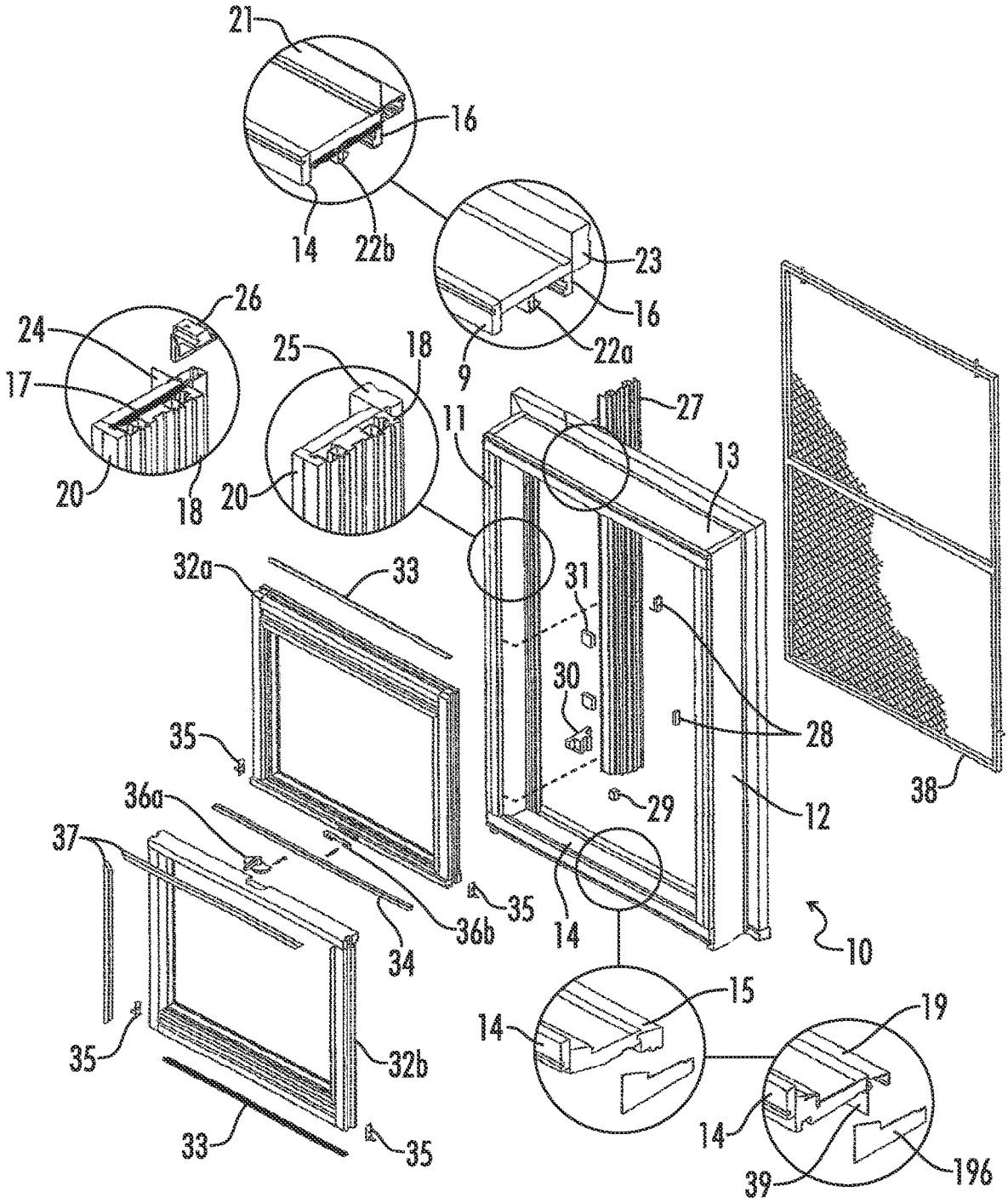
FIG. 2 is an exploded view of replacement window unit and old window frame components.

FIG. 2 is an exploded view illustrating the basic old or existing window and replacement window components. In the present inventor's system, as indicated above the old sashes and balance system, moldings, head and side blind stops and brickmold, parting stops, and sill nose are removed from around the old wooden window frame, while the old frame, including the side jambs 11 and 12, head jamb 13, sill assembly 14, and head and sill extender 9 are maintained. The new window has a strut attached to the head detail or blindstop 16, side jambs 11 and 12, and head jamb assembly 13 of the old frame, and a strut/aluminum clad 17 or other materials used to make windows are mated to the old jamb and old sill assembly 14. Side blindstop 18 is part of the clad of the new window. The new cladding connected to the strut 17 that forms the jamb and head are connected to the sill cover 19. The sill cover 19 is the base of the new window and the new window is a complete unit that enjoins the side jambs 11 and 12 to the head jamb 13 and connects the new sill 19 which covers the old sill when installed or connected with the old frame 10 from the exterior. The present system thus eliminates the need for coil stock/roll form metal used in the other methods.

The exterior frame cladding can be manufactured from materials such as aluminum, vinyl or fiberglass, synthetic materials, wood, or other metals. The cladding with or without a jamb liner/sleeve is connected to the old jamb after the old exterior casings/moldings, blind stops, and head stops are removed. The new window cladding with the jamb strut attached and balance system slide in to the old frame and connect with the old frame. The exterior clad side, head jamb and full sill cover need to fit tightly to the inside stops or side extender 20, and as seen in FIG. 2 as clad side blindstop 18 and strut 17 which join together and slide into and butt to side extender 20. The head jamb 13 and side jambs 11-12, and sill cover 15 are attached to the sash balance system, and are all completely weather-stripped. The jamb, head and sill covers with the sash balance system in one embodiment are backed with rigid Polystyrene or similar rigid plastics that will slide into the old window frame and attach to the old window frame with anchors (screw or fastener) through the balance channels or by engineered details to connect the Polystyrene to the old frame.

A drip cap nailing fin 21 is secured to the new side and head jam assemblies, as well as a new head parting stop or polystyrene strut 22*b* which replaced old strut 22*a*, while head brickmold 23 is also removed. In addition, a dripcap nailing fin 24 is provided on the new clad side jamb assemblies, while side brickmold 25 is removed from the old side jambs. Once installed, a frame corner key 26 is secured to the upper corners of the new side jamb assemblies. One of the jamb balance assemblies 27 is shown behind head jamb assembly 13 in FIG. 2. Also shown with respect to the old frame 10 in FIG. 2 are dust blocks 28 which are secured to the side jambs 11 and 12, a jamb plug 29, jamb liner sill pad 30, and spacer blocks 31. New top and bottom sash assemblies 32*a* and 32*b* are dimensioned to fit in the new window, and include weatherstripping 33 and a check rail weatherstrip 34. Sash pins 35 are positioned on the bottom sides of the new top and bottom sash assemblies 32*a* and 32*b*, and a sash lock 36*a* and sash keeper 36*b* are positioned to lock the sashes 32*a* and 32*b* when in a closed position. Glazing beads 37 are positioned between the sash rails and stiles and the glass. A screen 38 is provided and fits in the new clad frame assembly, and a sill cladding nailing fin 39 and sill and side jamb gasket which are optionally used where needed are shown. Also included in certain replacement window packages may be additional specialized components depending on the window design, such as a picture frame assembly, a screen accessory package, a concealed grille clip package, a metal joining/installation plate, corner gusset, glass shims, a nail fin stiffener bracket, brickmould, a 4⁹⁄₁₆" stool, and field applied add-on extender.

Figure 3:
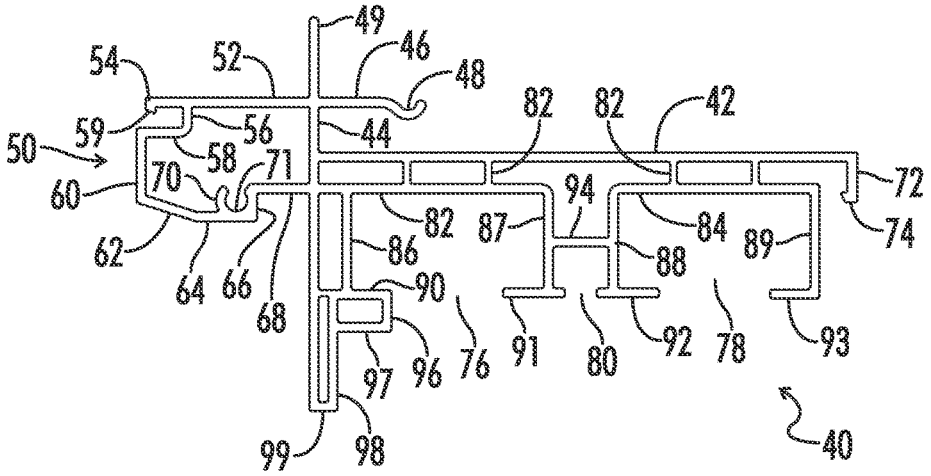
FIG. 3 is a side elevation view of a head and side jamb assembly in accordance with the invention.

FIG. 3 is an elevation view from an end of an embodiment of an elongated clad jamb assembly 40 constructed in accordance with the invention, which is used in forming the new side jambs and head jamb of the replacement window system. Assembly 40 in one embodiment is a rigid extrusion dimensioned to cover the jamb and is made from aluminum, vinyl, or fiberglass, and in other embodiments may be made of materials such as bronze, steel, resins or metal. As oriented in FIG. 3, assembly 40 includes a member 41 having a flat upwardly facing surface 42, which surface 42 when assembly 40 is fitted into an old window frame abuts against the old side jamb or head jamb. Arm 4 is connected extending outwardly from one edge of member 41, and an extension 46 having an upwardly concave channel 48 spaced from arm 44 extends inwardly from arm 44 such that when assembly 40 is installed, arm 44 fits along one side of the old frame side or head jamb, and extension 46 fits behind the old jamb. In addition, an auxiliary nail fin 49 is attached extending outwardly from arm 44, while in some embodiments the nail fin 49 can be removed for those applications that do not need a nail fin, such as masonry walls.

Structure 50 is formed integrally as part of assembly 40, and includes outwardly turned leg 52 which extends from arm 44 opposite inwardly turned arm 44, and has a rounded tip 54. Depending on the dimensions of the old window frame, in some embodiments, arm 46 and leg 52 are connected to arm 44 extending directly outwardly from each other or may be offset from each other. A short extension 56 extends downwardly from leg 52, and another extension 58 extends outwardly from short leg 56 to a position slightly beyond tip 54, forming outwardly facing groove 59. Another leg 60 extends downwardly from the outer end of extension 58, and the lower end of leg 60 is connected to angled extension 62 which extends downwardly and inwardly from leg 60. Angled extension 62 is connected on its other end to extension 64, which is also connected to short downward leg 66 and in turn to leg 68 which extends outwardly from the downwardly directed section of arm 44. A longitudinal track 71 is formed between leg 68 and rounded finger extension 70 which extends upwardly from leg 64. Longitudinal track 71 serves as a screw boss that enables screwing of the mitered parts together. When the old brickmold, and blind stop are removed from around the old window frame, a space is left between the house exterior materials (siding, block, stone, stucco) that is filled by structure 50 and components to be connected to structure 50. This includes attachment or application of a nail fin, commercial backer rod, caulking, flashing, and nail or screw anchoring. Structure 50 therefore is the exterior window casing included in the clad system. Lip 54 is an accessory kerf used to help hold in place any clad trim accessories applied to make the face of the window wider. Increasing the width helps close any gaps between the building and the exterior window casing. There is also a corner key (see FIG. 2) that hold the corners together and receives the benefit of the screwed corners.

Referring still to FIG. 3, arm 72 having an inwardly directed lip 74 depends downwardly from the end of member 41 opposite arm 44. A pair of aligned balance system channels 76 and 78 are formed on assembly 40 underneath member 41, and in addition a smaller channel or slot 80 is defined between channels 76 and 78. More particularly, several spaced apart structural members 82 extend downwardly from member 41 opposite upper surface 42 and perpendicularly intersect with channel walls 83 and 84. Spaced apart side walls 86, 87, and 88, 89 extend downwardly from walls 83 and 84, respectively, and inwardly turned legs 90, 91, and 92, 93, are provided on the outer ends of the side walls 83 and 84, respectively. In addition, wall 94 extends between side walls 87 and 88, and legs 91 and 92 also extend partially inwardly with respect to wall 94, narrowing the entrance of channel 80. Leg 90 also is joined to the downwardly extending portion of arm 44, and one end of extension 96 extends downwardly from the outer end of leg 90, with extension 97 extending outwardly from the other end of extension 96, extension 98 extending downwardly from extension 97, and short extension 99 joining between the lower end of arm 44 and extension 98, together essentially forming an L-shaped structure below leg 90 which serves as a sash guide when the window unit 10 is completely installed.

Figure 4:
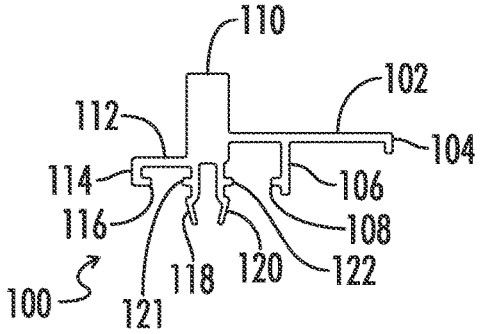
FIG. 4 is a side elevation view of a head adapter.
Figure 8:
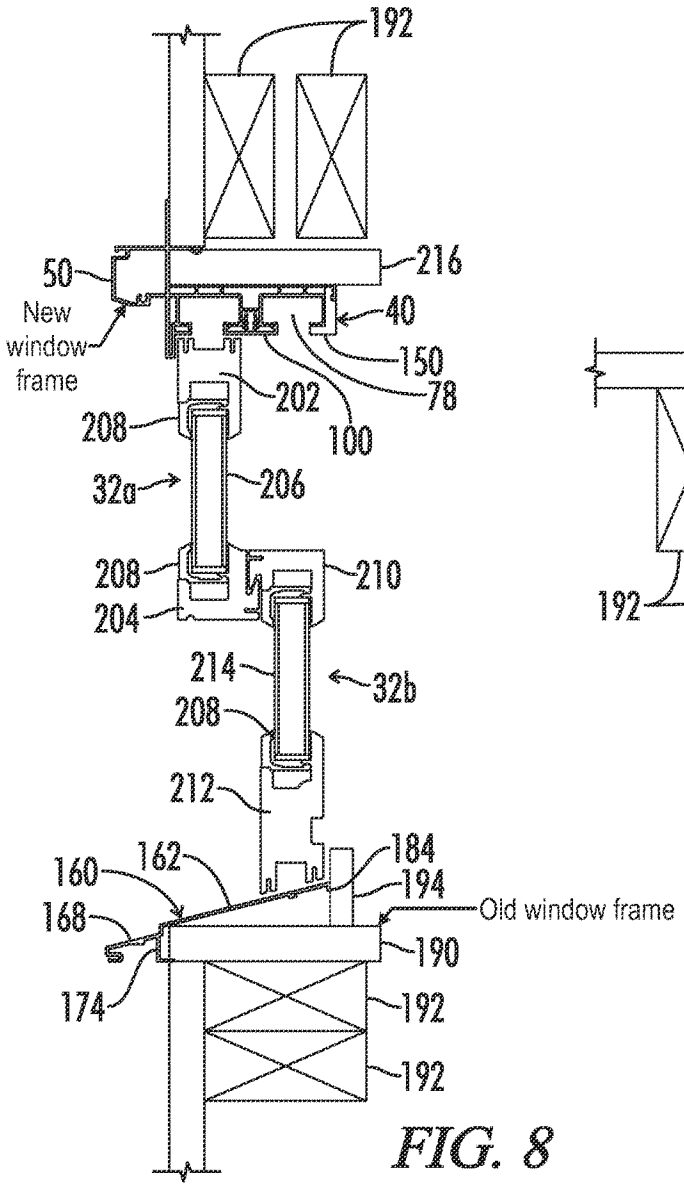
FIG. 8 is a diagrammatic side elevation view of the replacement window assembly.

FIG. 4 is an elevation view from an end of head adapter 100, which includes a flat upper section 102, a lip 104 which extends downwardly from one end of section 102, and an arm 106 that also extends downwardly from section 142 in the same direction as lip 104, and having a finger 108 spaced from surface 102. Head parting stop 110 is connected to flat section 102 opposite lip 104, and extension 112 is connected extending outwardly from parting stop 110 on the side opposite section 102. As shown in FIG. 8, head adapter 100 when secured to head jamb assembly 40 covers part of the interior head jamb, which provides a more attractive appearance and in addition blocks some air movement into the channels 76 and 78. In addition, head parting stop 110 divides the top and bottom sash to cover the open area in the head and also keeps the sash in check from moving in and out. Extension 114 extends downwardly from extension 112, and has an inwardly turned finger 116 on its outer end, which is horizontally aligned with finger 108 on arm 106. Opposed clip members 118 and 120 having fingers 121 and 122 which are horizontally aligned with fingers 108 and 116 extend from the lower end of head parting stop 110. As is also shown in FIG. 8, head adapter 100 is secured to head jamb assembly 40 with clip members 118 and 120 secured in channel 80 of assembly 40, while fingers 116 and 121 abut against leg 90, fingers 108 and 122 abut against leg 92, and lip 104 presses against extension 97 of assembly 40.

Figure 5:
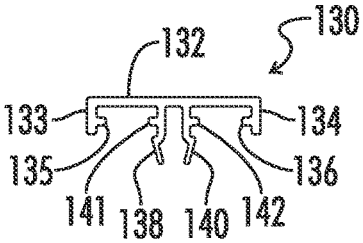
FIG. 5 is a side elevation view of a frame adapter.
Figure 9:
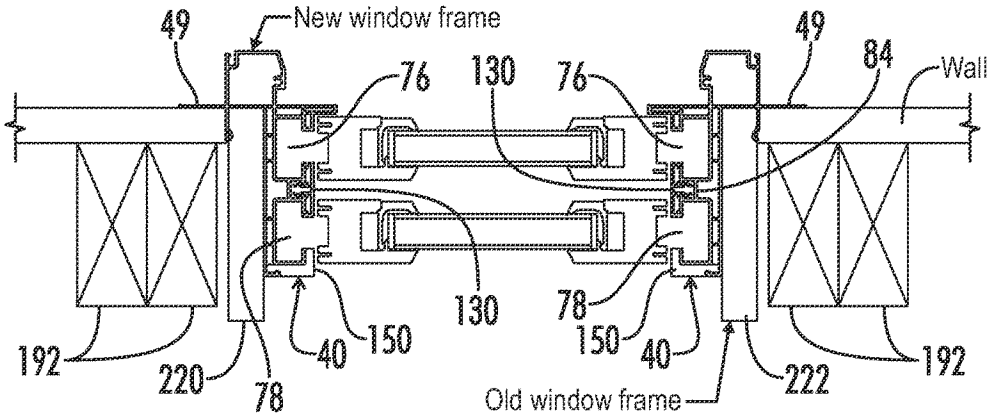
FIG. 9 is a diagrammatic top elevation view of the replacement window assembly.

FIG. 5 is an elevation view from an end of frame adapter 130, which as shown includes a flat elongated top section 132, arms 133 and 134 which extend from the ends of section 132 and each having an inwardly turned horizontally aligned finger 135 and 136. In addition, a pair of opposed flexible clip members 138 and 140 each also having horizontally aligned fingers 141 and 142 which are also horizontally aligned with fingers 135 and 136 are provided. As shown in FIG. 9, frame adapter 130 is secured to side jamb assembly 40 with opposed clip members 138 and 140 extending in slot or channel 80 between legs 91 and 92, and with fingers 135, 136, 141, and 142 pressing against legs 91 and 92. Frame adapter 130 covers the sash balances of replacement window unit 10, and in addition adds a contact for the weatherstrip provided on the side of the sashes.

Figure 6:
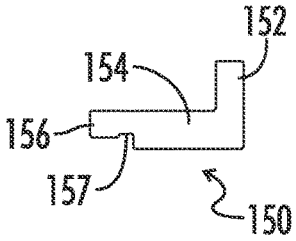
FIG. 6 is a side elevation view of an inside trim member.

FIG. 6 is an elevation view from an end of inside trim member 150, which generally has an L-shape including a first leg 152 and a second longer leg 154. Leg 154 has a reduced end portion 156 and a longitudinal notch 157 is formed along its outer edge. As shown in FIG. 9, inside trim member 150 is secured to the side jamb and head jamb assembly 40 by inserting reduced end portion 156 between lip 74 on arm 72 and the outer surface of flange 89 until lip 74 is extending into notch 157, with leg 152 extending over leg 93 and aligned with surface 132 of frame adapter 130 if attached to one of the side jambs or supporting leg 104 of head adapter 100 if attached to the head jamb assembly.

Figure 7:
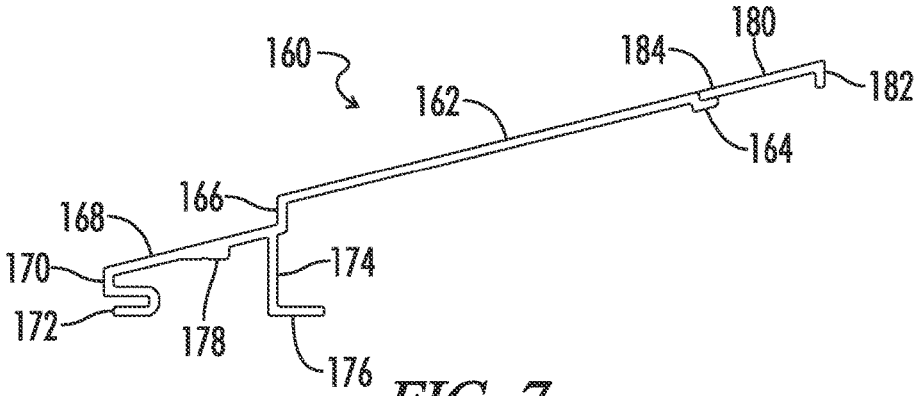
FIG. 7 is a side elevation view of a sill cover assembly.

FIG. 7 illustrates the clad sill cap or cover 160, which includes a main cap section 162 having an offset ledge 164 on one end, and a short downwardly directed leg 166 on its other end. Leg 166 connects to sill nose section 168 which in use covers the vertical front of the old sill or sill nosing and has a downwardly depending leg 170 on its forward end, and which leg 170 has a narrow U-shaped channel 172 formed on its lower end. In addition, another leg 174 having a perpendicular foot 176 directed towards main cap section 162 extends downwardly from nose section 168 spaced inwardly from leg 170, such that channel 172 and foot 176 are horizontally aligned. Groove 178 is also provided on the underside of sill nose section 168. In addition, a sill extension member 180 having a lip 182 on one end is provided, which is used to adjust the inside slope angle of the sill. End 184 of sill extension member 180 is positioned on ledge 164, where it may be secured by a flexible adhesive or the like, while lip 182 is abutting against the old window frame (see FIG. 8). Extension 180 provided the flexibility needed to allow for the angle needed to adjust and fit the sill cap to the old sill's angle.

As shown in the side diagrammatic sectional view of the replacement double hung window unit 10 in FIG. 8, main cap section 162 of sill assembly 160 fits over the main part of the old window frame or sill section 190, which is supported on studs 192, and with leg 174 over the front of the old sill, and lip 182 of extension section 180 pressing against member 194. Sill assembly 160 also connects to the side jamb assemblies 40 on either side of the old window frame, which side jamb assemblies are connected to the head jamb assembly. The old sill nosing 15 (see FIG. 2) may be removed depending upon its condition, but the main sill section 190 should remain unless it is deteriorated, in which case a CPVC sill or other substitute wood sill should replace the original sill. In addition, sill side caps 196 (also see FIG. 2) may be provided, which is dimensioned to fit over the ends of the old sill, and is optional on some embodiments.

Referring still to FIG. 8, there is also shown upper and lower replacement window sashes 32*a* and 32*b* which are pivotably secured to the window unit 10. Upper window sash 32*a* includes upper stile 202 and keeper rail 204, which support window 206 with glazing beads 208 inserted in the connection between the window 206, stile 202, and rail 204. Lower window sash 32*b* includes lock rail 210 and handle rail 212, which support window 214 also with glazing beads 208. In addition, new head jamb assembly 40 is shown connected to old window frame head jamb 216, with structure 50 positioned in front or to the outside of the old head jamb 216, and arm 46 positioned over the top of the old head jamb, and nail fin 49 extending upwardly over the outer surface of the building structure. In addition, head adapter 100 is secured to new head jamb assembly 40, with section 102 blocking channel 76 in assembly 40 so that the lock rail 210 of the bottom sash assembly will contact section 142 when the bottom sash is raised completely upwardly. Alternatively, in another embodiment, although less preferred head adapter 100 may be optional, or replaced with frame adapter 130 depending upon the desired amount of air infiltration and overall thermal requirements for the particular window unit. In addition, the upper rail of upper sash 32*a* is aligned with channel 76 of head jamb assembly 40. Inside trim member 150 is also secured to assembly 40 with leg 152 directed inwardly towards channel 78.

FIG. 9 is a top diagrammatic sectional view of the replacement double hung window unit 10, and shows old window frame side jambs 220 and 222 with new assemblies 40 which together define an opening and form the new window frame secured thereto. Each new side jamb assembly 40 has a frame adapter 130 connected between the channels 76 and 78, and in addition, inside trim member 150 is secured to assembly 40. The ends, top and bottom of the channels in one embodiment have installed tunnel pads that interconnect with the weatherstrip to block air and water leakage.

Assembly 40 may be secured to the building wall by nail fins 49, and in addition screws are passed through wall 94 between channel 76 and 78 directly into the side jambs 220 and 222 (in one embodiment the same is true with respect to the head jamb). Once the old frame cladding has been completely installed, then the counter balances and sashes are installed.

As indicated above, replacement window unit 10 is shipped completely assembled and dimensioned so that the unit slips over the old wood window jamb, sill and head, including the new sashes, sash locks and insect screen installed. When the window arrives at the project, it is ready to be installed. The sashes may be removed after installing for the purpose of accessing the area of the frame adapter 130, which can be removed so that anchor screws can be directed through wall 94 of the new side jamb assemblies 40, after which the frame adapter 130 is replaced. Sealant is applied behind the nail fin 49, and in the area where the interior of the replacement window unit 10 meets the inside stops, as well as at the exterior of the head, side jambs and sill. A polystyrene strut may be inserted behind the head and side jambs which serve as a tunnel pad to block air and water from leaking into the replacement window unit structure 10. In one embodiment, the clad sill assembly is connected to the new side jamb assemblies by a screw boss channel 71 which is built into the side jamb system in the spaces formed structural members 82 in assembly 40. In this arrangement, screws will be directed up through the underneath of the sill and into the screw boss channel in the side jamb.

In one method of practicing the present invention, first the installer will inspect the condition of the old window and take exact measurements of the old window, which are to be provided to the manufacturer of the window. When the new window arrives, it is completely assembled with the assembly configured to slip over the old wood window jamb, sill and head, and with the sash, sash locks and an insect screen installed. When the window arrives at the project, it is therefore already properly sized and ready to be installed. As indicated above, the sashes may be removed after installing for the purpose of accessing the area of the frame adapter, which is temporarily removed to install anchor screws, after which the frame adapter is replaced. To prepare the old opening to receive the new window, the old brick molding or exterior casing and exterior blind stop are removed. Next, the cavity space between the remaining window frame, sill, and head is inspected for any wood rot, old insulation, or insect infestations. Using a good quality insulation, low expanding foam, fiberglass batt type insulation and window and door graded caulking, is applied to the exterior edge of the old jamb, head and sill. The new replacement window unit 10 is then fitted over the old window frame by placing the head exterior open receptor slot over the old head jamb while rotating down on the side jambs. As the new side jambs slide over the old side jamb, the window unit is pressed evenly inwardly until the sill connects the old sill at the back stop. The installer will then plumb, level, and square the new window with respect to the old window frame, with shims being made available so the installer can adjust the frame to square up. Shims can also be used on the outside perimeter on the frame to square, plumb and level the new window. Once this is completed, one inch roofing nails are used to nail into the nail fin and anchor the new window. A drip cap is applied over the head of the new window unit, and the set of the window to the interior is checked. Further shims and caulk are used if necessary to achieve a proper appearance. When secured to the side jamb and connected on all four corners the unit becomes a fully assembled window in need of the wood head or side jamb of the old window. It is then married to the old wood side jamb, head jamb and sill. The unit is secured with the nail fin and or anchored through the side jamb. Anchoring through the side jamb is best done by removing the frame adapter.

Figure 10:
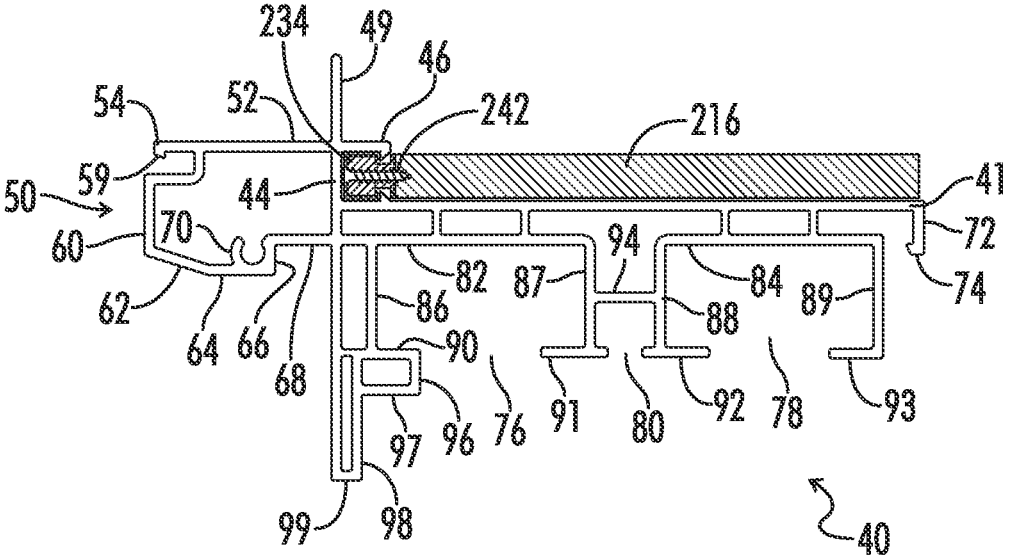
FIG. 10 is a side elevation view of the head and side jamb assembly incorporating an alternative clip attachment system.
Figure 11:
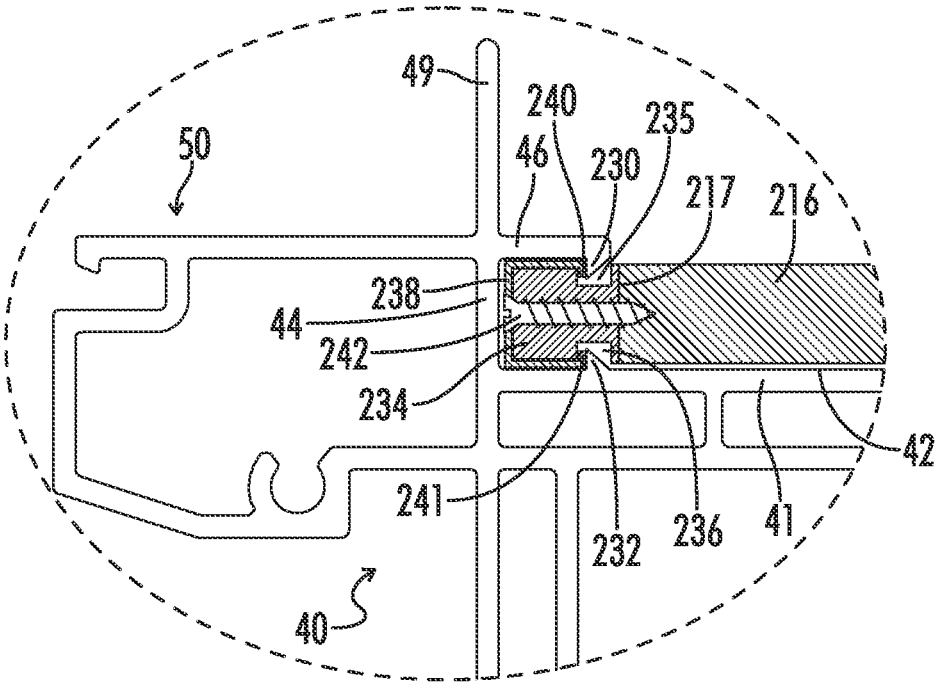
FIG. 11 is an enlarged view of the clip assembly shown in FIG. 10.

Since overall the window industry lacks commonality, there is a need to provide alternative arrangements for installing the replacement clad window system of the present invention to accommodate different window styles and manufacturers. For example, in some cases, the nail fin 49 may utilized to secure the cladding assembly over a window opening, while in other cases the fin 49 either alone or in combination with another attachment method is not appropriate. FIGS. 10 and 11 illustrate another embodiment of the invention wherein the head and side jamb assembly 40 shown in FIG. 3 has been modified to be used with a clip-style fastener arrangement to attach the front portion of the assembly 40 in the vicinity of structure 50 to the old wooden head and side jambs. In the illustrated embodiment, concave channel 48 shown in FIG. 3 on the end of extension 46 which as described above fits behind the old window frame head and side jamb, is removed. In addition, as best shown in FIG. 11, an inwardly directed projection 230 is provided on extension 46 at a location spaced apart from arm 44, and another inwardly directed projection 232 is similarly provided on member 41 extending outwardly from surface 42 in the direction of projection 230. In an embodiment, projections 230 and 232 are aligned.

A lineal member 234 is secured to the outwardly facing surface 217 of the old wood head jamb 216, shown in FIGS. 10 and 11, as well as to side jambs 220, 222 (not shown). Member 234 is made of a suitable material such as wood or plastic, and may extend along the entire length of the old head or side jamb. A pair of notches 235 and 236 is formed in opposite side walls of member 234, extending lengthwise. The outwardly and side facing walls of member 234 are covered at least at regular intervals by a clip 238, also preferably made of plastic, metal, or another suitable material. Clip 238 also includes a pair of tabs 240 and 241 which extend into notches 235 and 236, respectively, to secure the clip 238 to member 234, although an additional securing means such as an adhesive may also be used. Clip 238 also has an aperture in the wall covering the outwardly facing surface of member 234 through which a fastener 242 such as a wood screw is received. Fastener 242 is passed through the screw aperture in clip 238 into member 234 and further through outer surface 217 of the old jamb 216 to secure the member 234 to the old jamb 216. The screw head will be countersunk into clip 238 and member 234 such that it does not protrude out past the outwardly facing surface of the clip. In an embodiment, an adhesive or other securing means may also be used to secure the member 234 to the old jamb 216.

Once the lineal member 234 has been securely fastened to the outwardly facing surface 217 of the old jamb 216, the replacement window cladding may be installed. Head and side jamb assembly 40 of the cladding system is positioned over the old wooden head and side jambs with surface 42 of member 41 in abutting contact with the side surface of the jambs, and with arm 44 abutting against the outwardly facing surface of clip 238. When arm 44 of assembly 40 is pressed against the member 234, members 41 and 46 of assembly 40 extend over the sides of the clip 238 and member 234. The side walls of members 41 and 46 will initially flex outwardly until inwardly directed projections 230 and 232 reach notches 235 and 236, after which the side walls will flex inwardly as projections 230 and 232 extend into the notches 235 and 236, securing the assembly 40 to member 234 and as a result also to old jamb 216. Lineal member 234 thus provides an effective alternative means for securing the front portion of assembly 40 near structure 50 to an old jamb frame.

Figure 12:
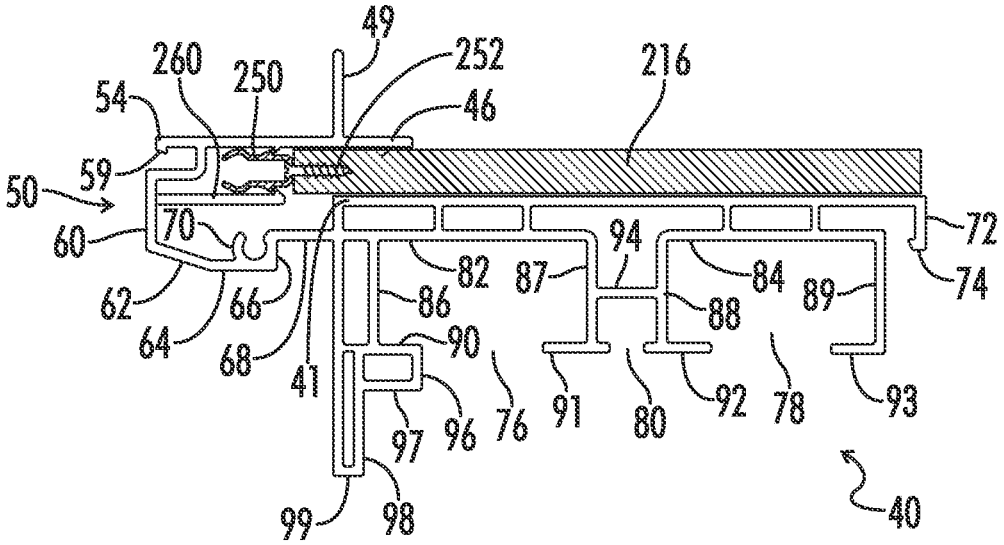
FIG. 12 is a side elevation view of a head and side jamb assembly incorporating another alternative clip attachment.
Figure 13:
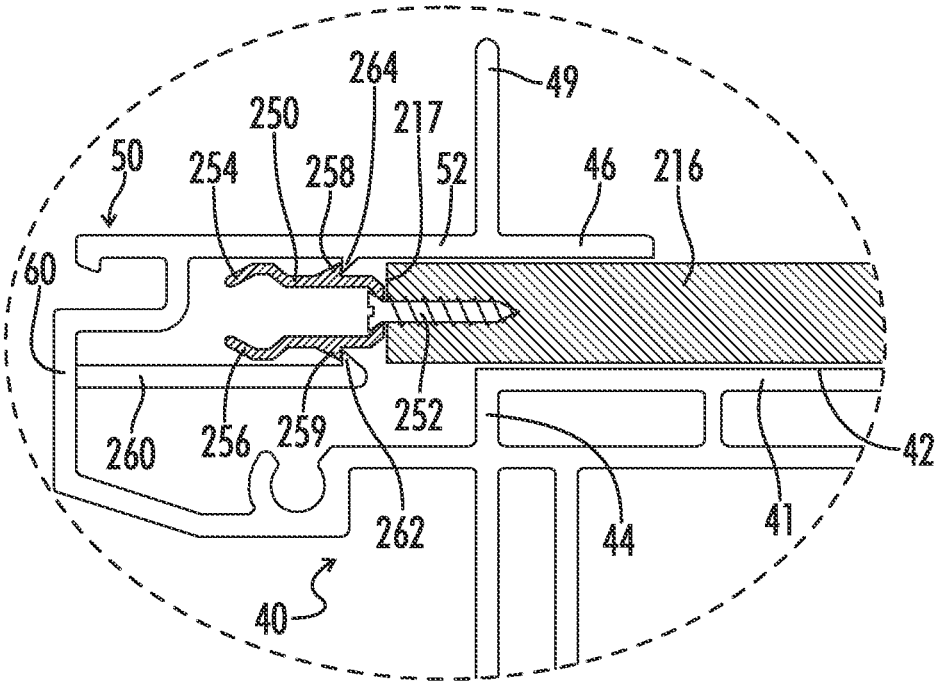
FIG. 13 is an enlarged view of the clip assembly shown in FIG. 12.

FIGS. 12 and 13 illustrate another embodiment wherein head and jamb assembly 40 has been adapted to be secured to the old jamb 216 using clip members 250. Clip 250 is a spring clip which may be of different types that is secured to the old jamb 216 oriented extending outwardly from wall 217. A suitable number of clips 250 may utilized as needed to secure the assembly 40 to the old jambs. Clips 250 are attached in a spaced apart manner along the length of wall 217 of old jamb 216 using a suitable fastening means such as a screw fastener 252. In the illustrated embodiment, clip 250 has a pair of spaced apart flexible legs 254 and 256 each having an outwardly facing projection 258 and 259.

Assembly 40 has been modified in the presently described embodiment to remove the portion of arm 44 connecting between members 41 and 46. A new member 260 is also provided, which extends inwardly from member 60 of structure 50. An inwardly directed projection 262 is provided near the inner end of member 260. Another inwardly directed projection 264 which is aligned with projection 262 is provided on member 52 of structure 50. Members 52 and 260 are spaced apart and oriented so as to receive clip 250 between the members 52 and 260. When the legs 254 and 256 of clip 250 are passed between the members 52 and 260, the legs 254 and 256 must press or flex inwardly towards each other to allow the tabs 258 and 259 to pass between the projections 262 and 264. Once the legs 254 and 256 of clip 250 have been passed sufficiently inwardly such that the tabs 254 and 256 are beyond projections 262 and 264, the legs 254 and 256 will again flex outwardly, such that the tabs 258 and 259 are now positioned behind the projections 262 and 264, preventing the clip 250 from being disconnected from inside structure 50 and from assembly 40 without first pressing the legs 254 and 256 of clip 250 together. When all the clips 250 are secured as described, the head and side jamb assembly 40 is effectively connected to the front of old window jamb 216.

While the present invention has been described with respect to the installation of double hung replacement windows, in another embodiment the invention may be used with casement and awning windows. The present system requires eight sash parts for a double hung window and four sash parts for a casement/awning window. This present design can be used for replacement of casements and awnings with modifications to a casement/awning sill cover and no frame blind stop inside or out, and a sash stop will be added to the location of the parting bead and head stop. The materials used in manufacture of the inventor's replacement window system can be any of the materials used to manufacturer windows including but not limited to any metal, any PVC, any CPVC, any fiberglass, any vinyl, and any wood configuration that incorporated the attributes of the invention. The present invention converts an old window into a modern day clad window using materials including aluminum cladding, vinyl cladding, fiberglass cladding, and other metal claddings. The entire window framing material can be all vinyl, PVC, metal, fiberglass or wood.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls. While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

What is claimed is:

1. A replacement window cladding system adapted to be clad to a previously installed window frame comprising:

an elongated clad jamb assembly including a clad head jamb and a pair of clad side jambs, the clad head jamb extending between and interconnecting the clad side jambs, and an exterior window casing structure connected extending along an outer side of at least a portion of the clad head and side jambs; and a connector arrangement for joining the clad jamb assembly to head jamb and side jambs of the previously installed window frame, said connector arrangement including one or more attachment members secured along a length of an outwardly facing wall of said head and side jambs of the previously installed window frame, wherein the attachment members further comprise a plurality of spaced apart clip members having a clip section which extends outwardly from the previously installed window frame, and screw fasteners for securing the clip members to the head and side jambs of the previously installed window frame, and a receiving structure connected to or formed as part of the clad jamb assembly in a position to be coupled with the attachment member, wherein the receiving structure is adapted to receive the clip member in the receiving structure for connecting the clad jamb assembly to the head and side jambs of the previously installed window frame.

2. The replacement window cladding system of claim 1 wherein the clad head and side jambs of the clad jamb assembly additionally comprise a pair of aligned balance system channels, and an upper window sash and a lower window sash which are slidably mounted to the clad jamb assembly.

3. The replacement window cladding system of claim 2 wherein the clad head and side jambs of the clad jamb assembly are made by extrusion.

4. The replacement window cladding system of claim 2 wherein the pair of aligned balance system channels are aligned with side walls of the head and side jamb structure of the previously installed window frame when the clad jamb assembly is installed.

5. The replacement window cladding system of claim 1 further comprising a double hung window.

6. The replacement window cladding system of claim 1 further comprising a sill cover extending between and interconnecting the clad side jambs of the clad jamb assembly and adapted to be clad to a sill portion of the previously installed window frame.

7. The replacement window cladding system of claim 1 wherein the clip section of the clip member further comprises a spring clip.

8. The replacement window cladding system of claim 7 wherein the clip section further comprises a pair of spaced apart legs, each of said legs having a laterally extending tab, and wherein the receiving structure further comprises an opening in which the clip section is received with one or more inwardly directed projections positioned along said opening such that when the clip section is inserted into the opening the spaced apart legs of the section are caused to flex inwardly to allow the clip section to be fully inserted into the receiving structure, after which the legs are able to flex outwardly securing the clip section in the clip receiving structure.

9. The replacement window cladding system of claim 8 wherein the receiving structure is located within the exterior window casing structure of the clad jamb assembly.

10. The replacement window cladding system of claim 1 wherein the clad jamb assembly further comprises a leg adapted to extend behind the head and side jambs of the previously installed window frame.

11. The replacement window cladding system of claim 1 further comprising a sill assembly.

12. The replacement window cladding system of claim 11 wherein the sill assembly further comprises a main cap section and a sill extension enabling the sill assembly to be adjusted to be clad to a sill cap of a previously installed sill.

13. The replacement window cladding system of claim 12 wherein the sill assembly is connected extending between the clad side jambs of the clad jamb assembly.

14. The replacement window cladding system of claim 1 wherein the receiving structure further comprises a rectangular slot in which the outer wall of the head or side jambs of the previously installed window frame is received upon installation of the clad jamb assembly.

15. The replacement window cladding system of claim 1 wherein the attachment member comprises a lineal member, said lineal member having an outwardly facing wall, opposed side walls, and a notch extending lengthwise in each of the opposed side walls, and the receiving structure comprises a slot formed in the clad jamb assembly and a pair of inwardly directed projections each adapted to receive one of the notches in the lineal member.

16. The replacement window cladding system of claim 15 further comprising a clip securable over the outwardly facing wall and opposed side walls of the lineal member, said clip having a pair of tabs each adapted to extend into one of said notches in said opposed side walls.

17. The replacement cladding system of claim 16 further comprising an aperture in the clip for receiving a fastener passed into the outwardly facing wall of the lineal member and then into said head or side jamb for securing the lineal member to the head or side jamb.

18. The replacement window cladding system of claim 17 wherein the clad head and side jambs of the clad jamb assembly additionally comprise a pair of aligned balance system channels, and an upper window sash and a lower window sash which are slidably mounted to the clad jamb assembly.

19. A replacement window cladding system adapted to be clad to a previously installed window frame comprising:

an elongated clad jamb assembly including a clad head jamb and a pair of clad side jambs, the clad head jamb extending between and interconnecting the clad side jambs, and an exterior window casing structure connected extending along an outer side of at least a portion of the clad head and side jambs;

a connector arrangement for joining the clad jamb assembly to head jamb and side jambs of the previously installed window frame, said connector arrangement including an attachment member secured to an outwardly facing wall of said previously installed window frame head and side jambs, and a receiving structure connected to or formed as part of the clad jamb assembly in a position to be coupled with the attachment member; and a sill assembly having a main cap section and a sill extension enabling the sill assembly to be adjusted to be clad to a sill cap of a previously installed sill.

20. The replacement window cladding system of claim 19 wherein the attachment member further comprises a clip member having a clip section which extends outwardly from the previously installed window frame when the clip member is secured to said previously installed window frame, and the receiving structure is adapted to receive the clip member in the receiving structure for connecting the clad jamb assembly to the head and side jambs of the previously installed window frame.

* * * * *